US007077218B2

(12) United States Patent
Justis et al.

(10) Patent No.: US 7,077,218 B2
(45) Date of Patent: Jul. 18, 2006

(54) MOTOR HOUSING AND ASSEMBLY PROCESS FOR POWER TOOL

(75) Inventors: Michael S Justis, Rosedale, MD (US); Thomas J Bodine, Glenwood, MD (US); Barry E Plato, Bel Air, MD (US); Brent A Kuehne, Street, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/849,983

(22) Filed: May 20, 2004

(65) Prior Publication Data

US 2005/0257945 A1 Nov. 24, 2005

(51) Int. Cl.
*B25F 5/00* (2006.01)

(52) U.S. Cl. ..... 173/217; 173/170

(58) Field of Classification Search ..... 173/170, 173/217, 93.5, 169, 216
See application file for complete search history.

(56) References Cited

U.S. PATENT DOCUMENTS

| | | | | |
|---|---|---|---|---|
| 1,754,222 | A * | 4/1930 | Connell | 173/217 |
| 2,024,276 | A * | 12/1935 | Sesoutter | 137/217 |
| 2,383,379 | A * | 8/1945 | Frithiof | 173/217 |
| 2,430,527 | A * | 11/1947 | Mitchell | 173/170 |
| 3,369,615 | A * | 2/1968 | Maffey, Jr. et al. | 173/93.6 |
| 4,991,472 | A | 2/1991 | Hollingsworth | |
| D392,863 | S | 3/1998 | Sugimoto et al. | |
| D403,219 | S | 12/1998 | Bosten et al. | |
| D437,761 | S | 2/2001 | Okumura et al. | |
| 6,502,648 | B1 * | 1/2003 | Milbourne | 173/178 |
| D469,673 | S | 2/2003 | Sliker et al. | |
| 6,536,536 | B1 * | 3/2003 | Gass et al. | 173/2 |
| 6,719,067 | B1 * | 4/2004 | Taga | 173/93.5 |
| 6,896,073 | B1 * | 5/2005 | Fuchs | 173/217 |
| 2003/0121679 | A1 | 7/2003 | Taga | |

FOREIGN PATENT DOCUMENTS

| | | | |
|---|---|---|---|
| DE | 19918118 | A1 | 11/2000 |
| EP | 0856385 | B1 | 12/1997 |
| WO | WO 2004/002689 | A1 | 1/2004 |

* cited by examiner

*Primary Examiner*—Scott A. Smith
(74) *Attorney, Agent, or Firm*—Harness, Dickey & Pierce, P.L.C.

(57) ABSTRACT

A handle for a power tool is provided including a field case and front handle portion formed as a single piece. The front handle portion has an opening in a rear side thereof for receiving the wiring for the power tool. The wiring is connected to a motor that is mounted in the field case. A rear handle portion is attached to the front handle portion for covering the opening in the rear of the front handle portion. An end cap is connected to a rear of the field case for covering the remaining exposed wires connected to the motor. With the front handle design, the wire-up of the power tool can be completed from one side of the tool without having to turn the tool over during the wire-up process.

8 Claims, 6 Drawing Sheets

MOTOR HOUSING AND ASSEMBLY PROCESS FOR POWER TOOL

FIELD OF THE INVENTION

The present invention relates to power tools, and more particularly, to a motor housing and assembly process for a power tool.

BACKGROUND OF THE INVENTION

A common problem with power tools, particularly portable power tools of the mid-handle configuration having a "jam-pot" construction, concerns the ability with which a power tool so constructed may be assembled. Typically, power tools having a jam-pot construction are assembled in a process wherein the subcomponents which form the wiring are initially installed into a first jam-pot opening and thereafter, the subcomponents are feed out through a second jam-pot opening.

An often and time-consuming operation in this process concerns the connection of the wires from a power source such as a cord or a battery pack to the trigger switch and motor assembly. In a mid-handle tool, the connection of these wires can require that the tool be reoriented multiple times. The assembly operation is such that the wires are fed through a narrow opening in the housing to later be connected to the field and brushes. The tool must be reoriented to make these connections. Additionally, mid-handle tools require an opening in the housing from the handle area to the field area to allow the wires to pass through. This opening causes the motor fan to circulate some air in the handle portion, which degrades its ability to move air through the motor for cooling.

SUMMARY OF THE INVENTION

Accordingly, a power tool overcoming the above-mentioned drawbacks is provided herein. The power tool includes a housing including a field case and front handle portion formed as a single piece, the front handle portion has an opening in a rear side thereof with a rear handle portion attached to the first handle portion for covering the opening. An end cap is connected to a first end of the field case. A motor is disposed in the field case which defines a generally cylindrical motor chamber. A trigger switch is disposed on the front handle portion and an electrical wire system including a plurality of wires is connected to the motor through the first end of the field case. The wires extend along an outer side surface of the field case and along the rear opening in the front handle portion. The wires are covered by the end cap and second handle portion of the housing. With the system of the present invention, the front handle design simplifies the wire-up of the power tool as well as simplifying the overall assembly of the power tool. In particular, all of the wire-up occurs on the rear side of the tool with no need to flip the tool over to complete the wire-up assembly. Also, the wires are along the outside of the housing, which allows the opening between the handle portion and motor portion of the housing to be removed. This improves the motor fan's ability to move air through the motor, by eliminating the air circulating in the handle portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

With reference to FIGS. 1–9, the power tool assembly according to the principles of the present invention will now be described. It should be understood that although the power tool of the present invention is illustrated in the form of a impact wrench-type power tool, the present invention can also be used with other power tools such as drills, hammer mechanisms, and other mid-handle type power tools, corded and cordless.

Figure 1:
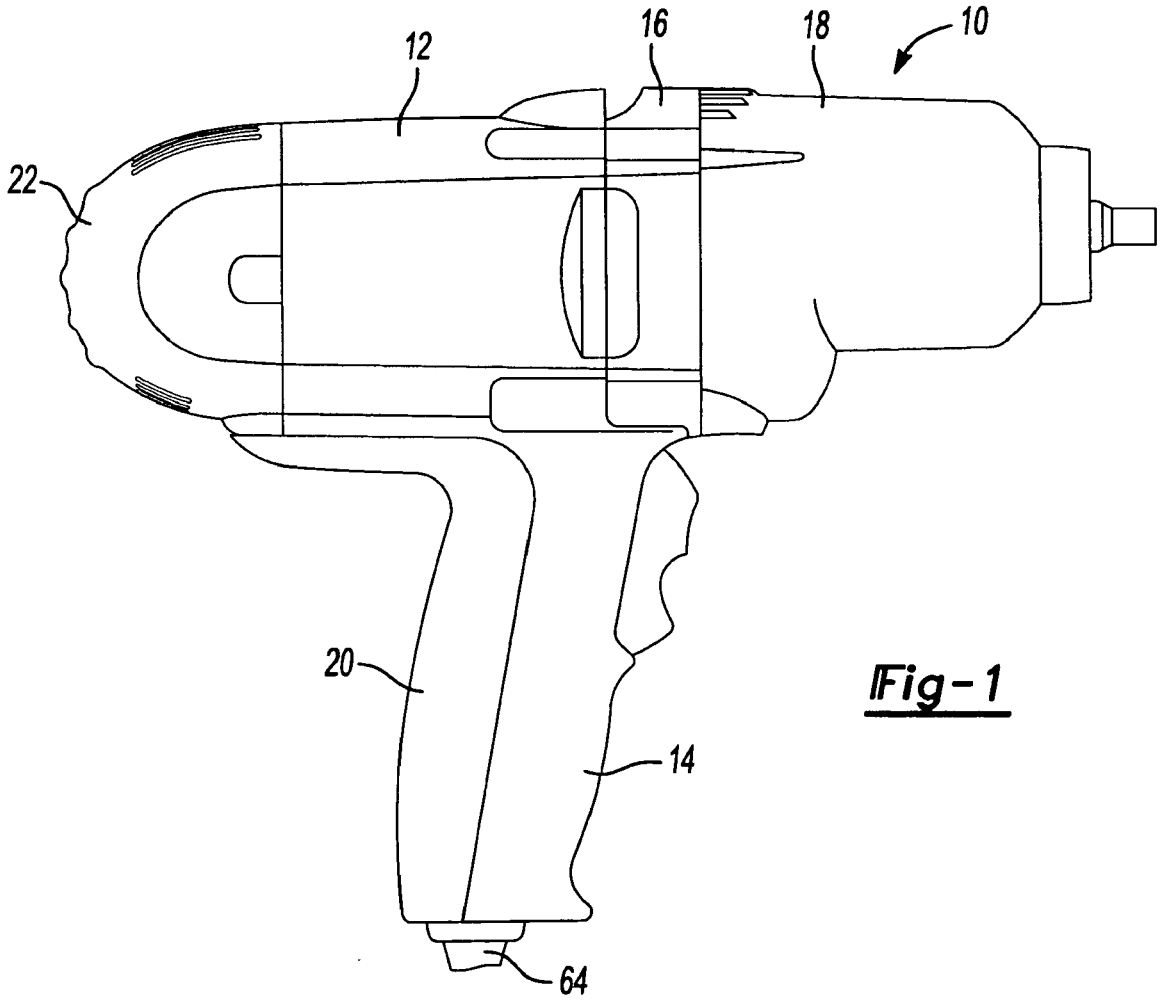
FIG. 1 is a side plan view of a power tool constructed in accordance with the principles of the present invention.

With reference to FIG. 1, power tool 10 is illustrated as including a field case 12 and front handle portion 14 formed as a unitary piece. A gear case cover 16 is mounted to a front of the field case 12 and a gear case 18 is mounted to the gear case cover 16. A rear handle portion 20 is mounted to the front handle portion 14 and an end cap 22 is mounted to a rear portion of the field case 12.

Figure 2:
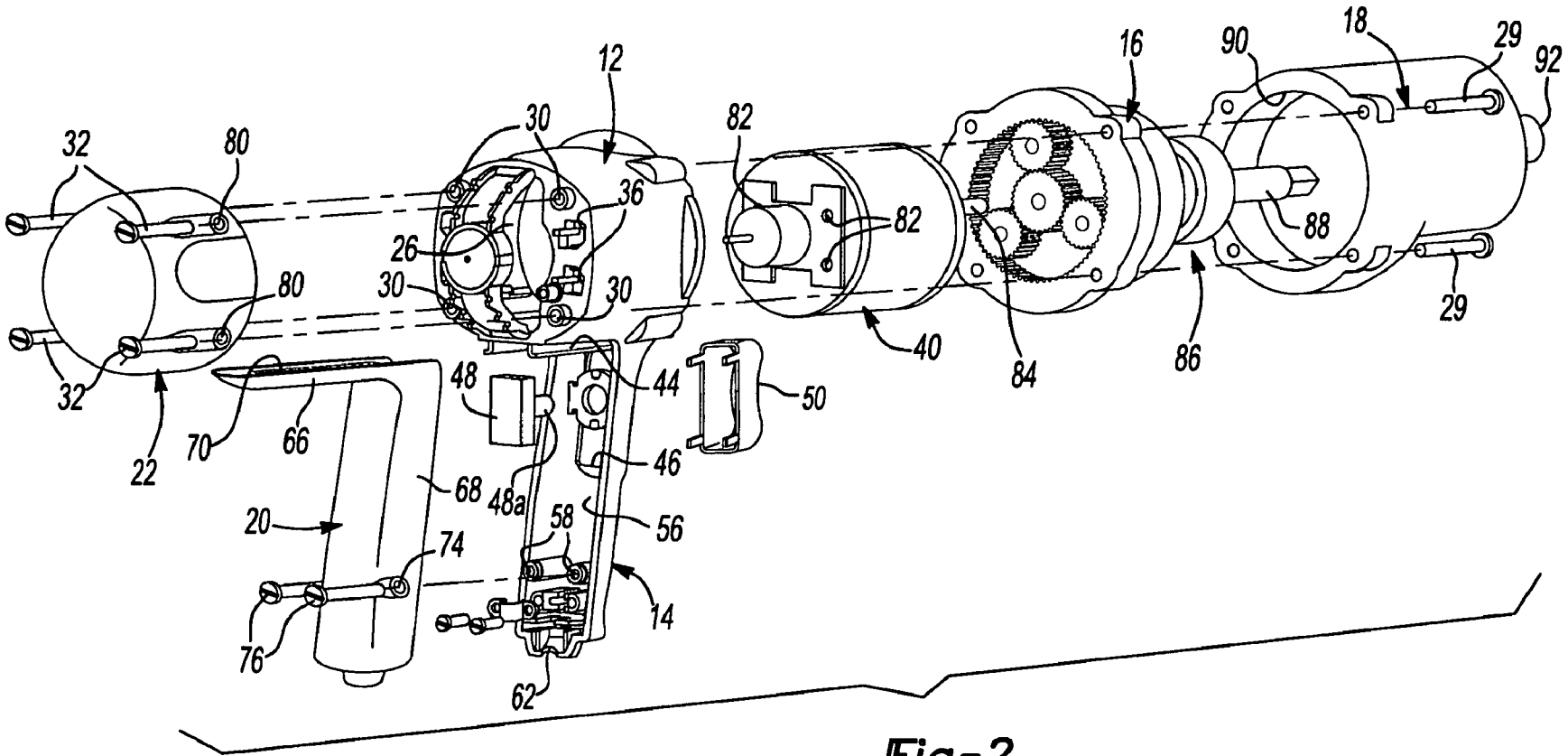
FIG. 2 is an exploded perspective view of the major components of the power tool according to the principles of the present invention.
Figure 3:
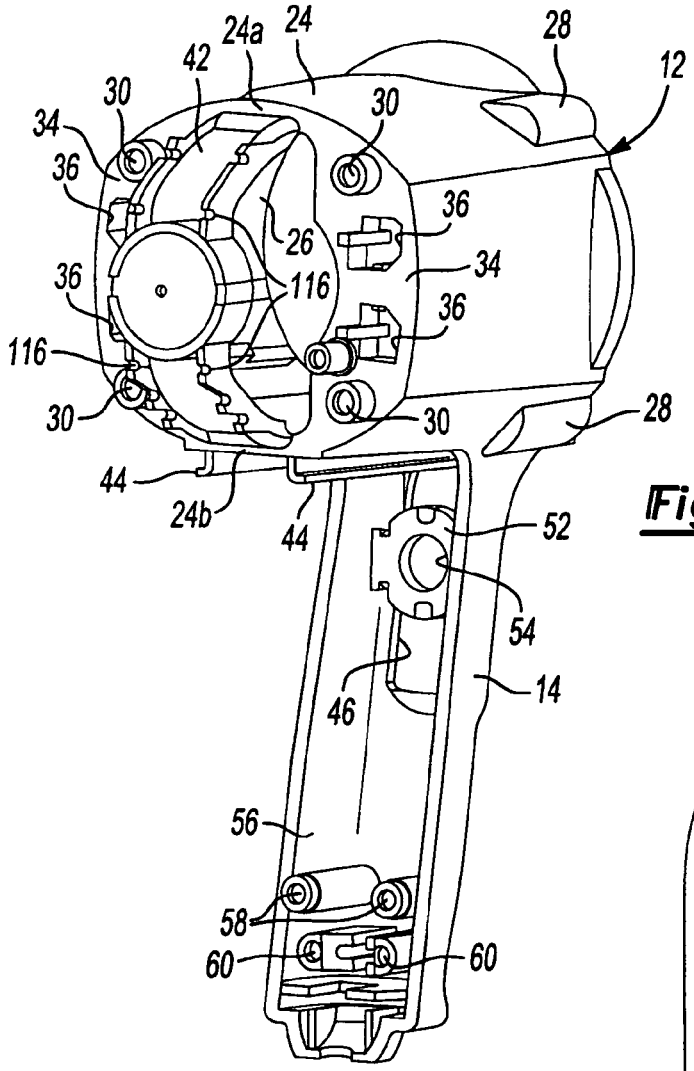
FIG. 3 is a rear perspective view of the field case and integrated front handle design according to the principles of the present invention.

As best illustrated in FIG. 3, the field case 12 includes a generally cylindrical wall portion 24 defining a motor chamber 26 for receiving a motor 40 (best shown in FIG. 2). A plurality of screw bosses 28 are provided in a front end of the field case 12 for receiving threaded fasteners 29 (shown in FIG. 2) for fastening the gear case cover 16 and gear case 18 to the field case 12. As shown in FIG. 2, a plurality of screw bosses 30 are provided in a rear surface of the field case 12 for receiving threaded fasteners 32 for mounting the end cap 22. With continued reference to FIG. 3, the rear surface of the field case 12 includes radially inwardly extending wall sections 34 exposed on opposite sides thereof. The wall sections 34 include apertures 36 for receiving electrical connectors to the motor 40 therethrough. A bridge section 42 is provided at the rear end of the field case 12 and extends from an upper side 24*a* of wall 24 to a lower side 24*b* thereof. A slide rail structure 44 is provided on the lower side 24*b* of the cylindrical side wall 24. Although the slide rail structure 44 is illustrated as a pair of L-shaped guide rails, it should be understood that other configurations can be utilized including a single rail system or having different shaped rails.

Figure 5:
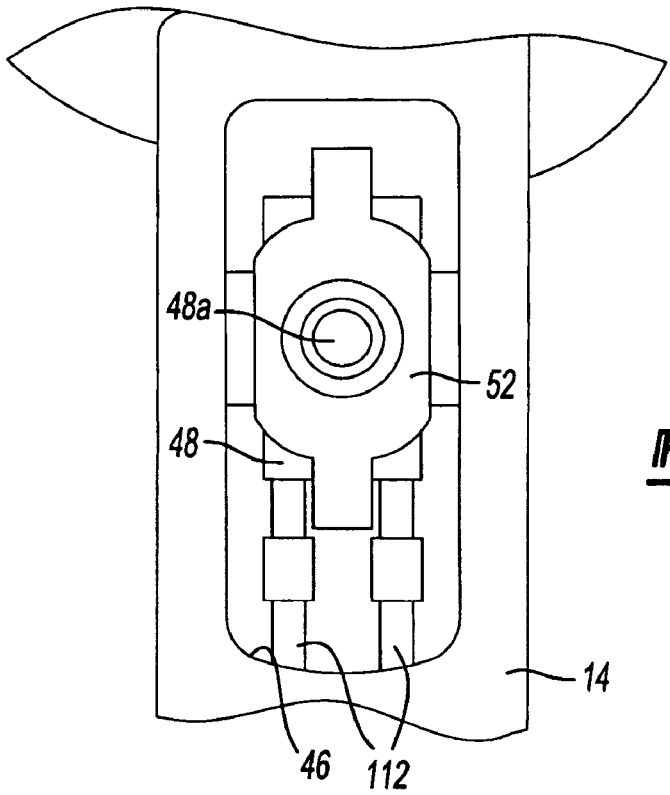
FIG. 5 is a plan view of the trigger switch mounted within the front handle portion according to the principles of the present invention.
Figure 6:
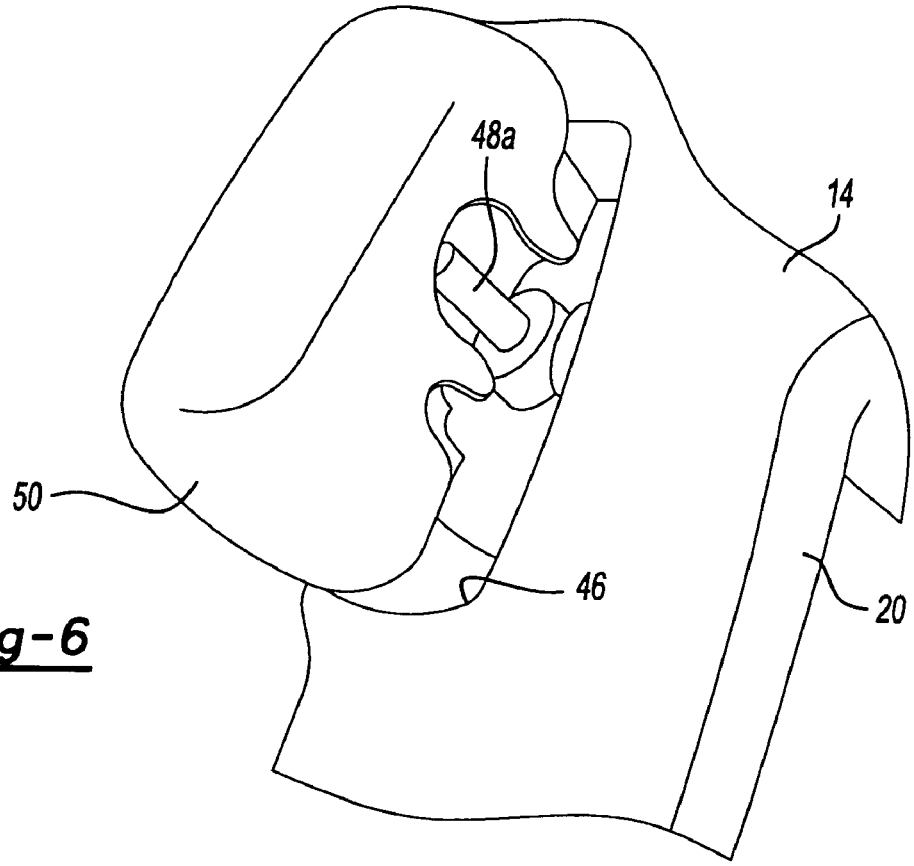
FIG. 6 is a side perspective view of the assembly of a rocker switch trigger being snapped into position on the front handle portion.

The lower handle portion 14 is integrally formed with the field case 12 as a unitary member which is preferably formed by injection molding utilizing a single direction mold that provides for less complicated tooling and eliminates a parting line from the front handle portion 14 and field case 12. The parting is moved to the transition area between the motor portion and the handle portion of the housing The front handle portion 14 includes an aperture 46 therethrough at an upper portion thereof for receiving a switch 48 (best shown in FIG. 2). The switch 48 includes a toggle type actuator 48*a*, which is activated by a trigger 50, as best illustrated in FIGS. 2, 5, and 6. A bridge member 52 is integrally molded with the front handle portion 14 and extends across the aperture 46. The switch assembly 48 is captured between the bridge member 52 and the rear handle portion or could be held with fasteners, clips, or the like. The bridge member 52 has an aperture 54 therethrough for receiving the toggle 48*a* of the switch assembly 48. The front handle portion 14 has a rear opening or cavity 56. A pair of screw bosses 58 are provided at a lower end of the front handle portion 14 along with a pair of clamp bosses 60. A recess region 62 is provided in the end of the front handle portion 4. The recess region 62 receives a cord 64 therethrough.

Figure 4:
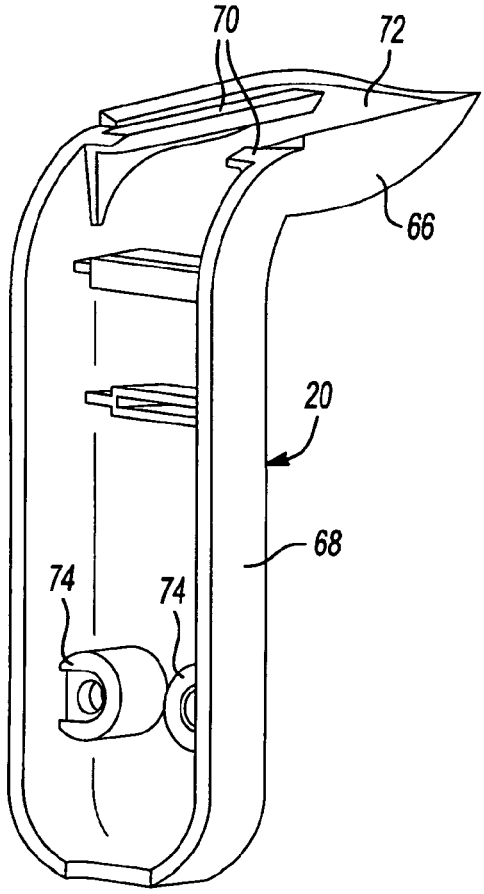
FIG. 4 is a front perspective view of the rear handle portion according to the principles of the present invention.

With reference to FIGS. 2 and 4, the rear handle portion 20 includes a generally L-shaped body including an upper cover portion 66 and a lower cover portion 68. The upper cover portion 66 includes a pair of slide rails 70 which engage with slide rails 44 on the lower surface 24*b* of the field case 12. The upper cover portion 66 covers the slide rails 44 and defines a chamber 72 for receiving several wires therethrough as will be explained in greater detail herein.

Figure 8:
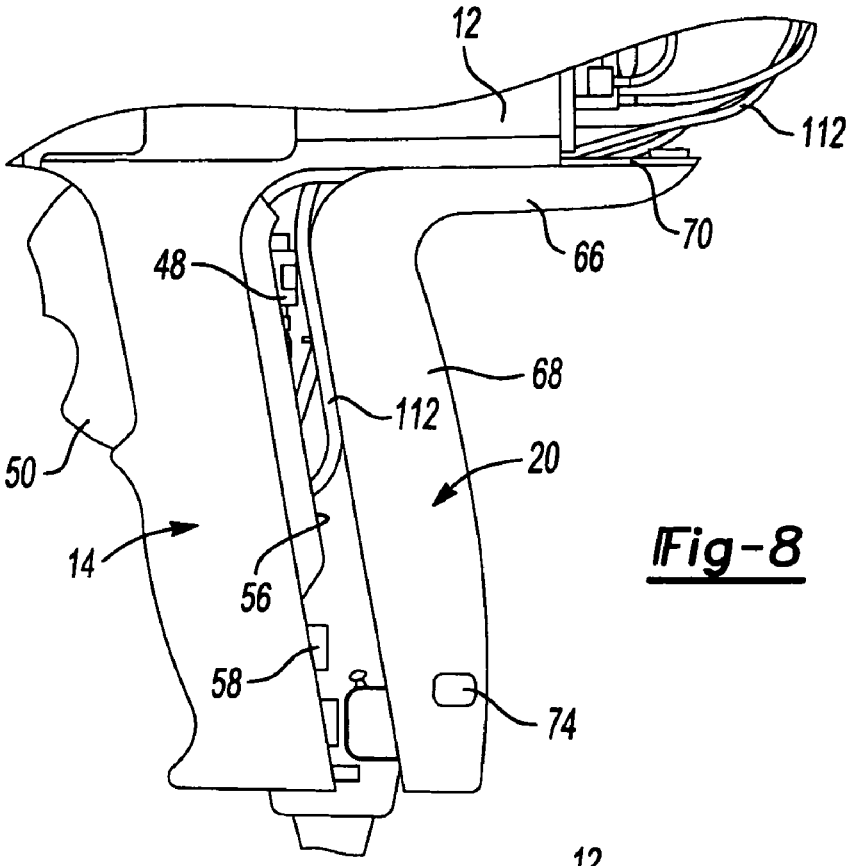
FIG. 8 illustrates the engagement of the rear handle portion to the front handle portion and field case according to the principles of the present invention.

The lower cover portion 68 of rear handle portion 20 covers the opening 56 in the rear of the front handle portion 14. A pair of screw bosses 74 are provided at a lower end of the lower cover portion 68 of the rear handle portion 20 for receiving threaded fasteners 76 (best shown in FIG. 2) for fastening the rear handle portion 20 to the front handle portion 14 wherein the screws 76 engage screw bosses 58 provided in the front handle portion 14. FIG. 8 illustrates the rear handle portion 20 being engaged with the front handle portion 14 and showing the sliding engagement between slide rails 70 of the rear handle portion 20 and the slide rails 44 provided on the lower surface 24*b* of the field case 12.

As shown in FIG. 2, the end cap 22 is generally semi-spherical in shape and includes a plurality of screw bosses 80 for receiving threaded fasteners 32 therethrough for mounting the end cap 22 to the field case 12 via screw bosses 30 provided on the field case 12.

The motor 40 is received in the motor chamber 26 of the field case 12. Electrical connections to the motor 40 are provided through apertures 36 provided in the field case 12 for connection to terminal posts 82 which are mounted to the motor 40. The output shaft 84 of the motor 40 is drivingly connected to a gear system provided in gear case cover 16. The gear system can be of the multi-speed type that can be manually switched by the operator, or a single speed type. An impact mechanism 86 is driven by the gear system and includes an output spindle 88. The gear case 18 is received over top of the impact mechanism 86. The impact mechanism 86 is well known in the art and therefore, a detailed description thereof will be omitted. The gear case 18 includes a rear opening 90 for receiving the impact mechanism 86 and a front opening 92 for receiving the output spindle 88 therethrough. Threaded fasteners 29 are provided for mounting the gear case 18 and gear case cover 16 to the field housing 12.

Figure 7:
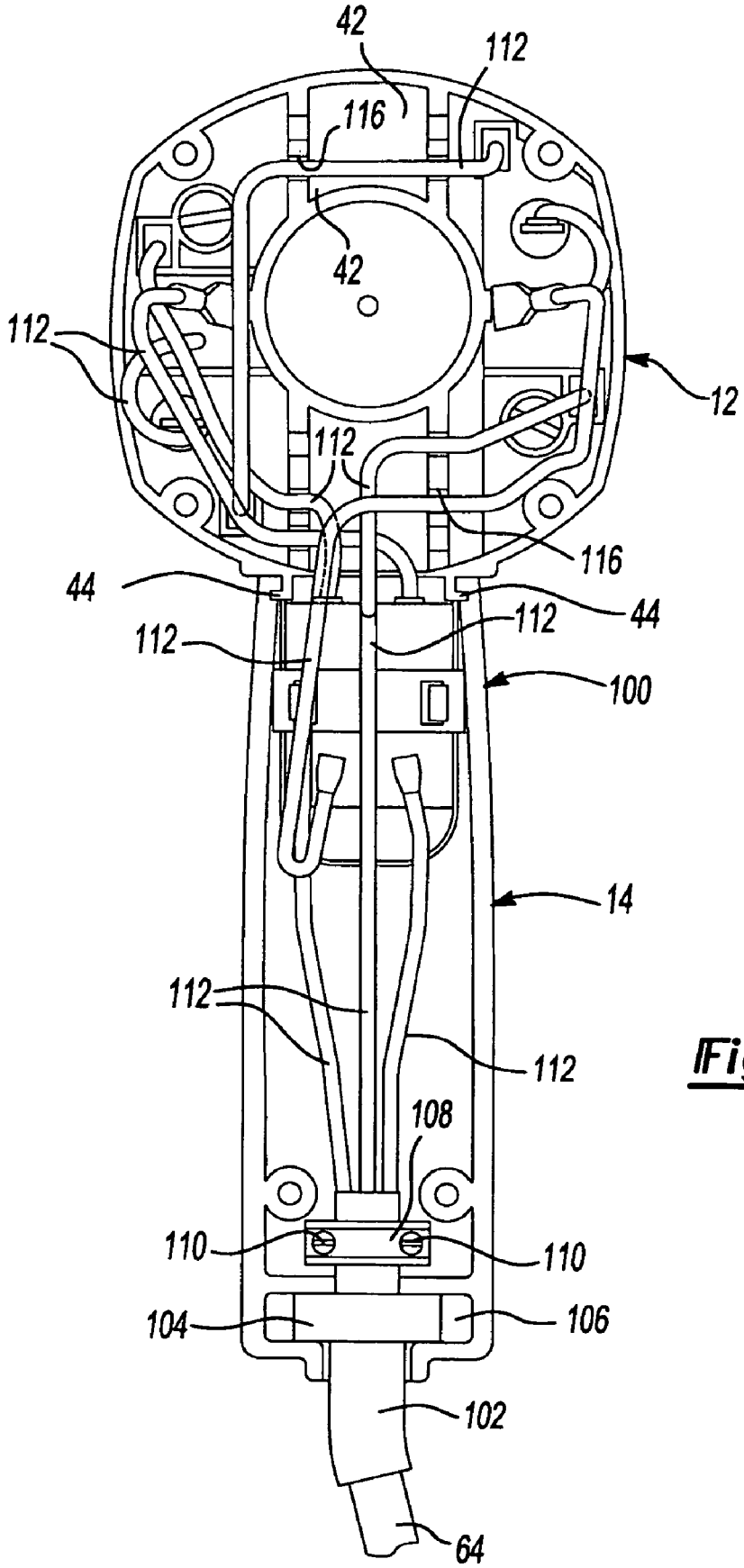
FIG. 7 is a rear view of the field case and integrated front handle being wired up according to the principles of the present invention.

With reference to FIG. 7, a rear view of the field case 12 and front handle portion 14 is shown with the wire system 100 illustrated in a full "wired-up" condition. As illustrated in FIG. 7, the cord 64 is attached to the housing by a flanged rubber boot 102 with a flange 104 being received in a recess region 106 in the front handle portion 14. A clamp plate 108 and threaded fasteners 110 are provided for securing the cord 64 to the front handle portion 14 via the clamp bosses 60. The cord 64 includes two wires 112 which are connected to the switch 48 and motor 40 in a manner that is well known in the art. Additional wires 112 extending from the switch to the motor are connected to the motor in a manner that is well known in the art.

The wires 112 extend through the opening or cavity 56 in the rear of the front handle portion 14 and between slide rails 44 of the field case 12 and along bridge 42 in the rear of field case 12. The bridge 42 is provided with anchor slots 116 in which wires 112 can be inserted prior to or after connection to the motor terminals.

As illustrated in FIG. 8, after the "wire-up" is complete, the rear handle portion 20 is then installed over the wires 112 to enclose the rear opening 56 in the front handle portion 14. The slide rails 70 of the upper cover portion 66 of rear handle portion 20 engage slide rails 44 provided on the field case 12 while the upper cover portion 66 covers the wires 112 disposed between the slide rails 44.

Figure 9:
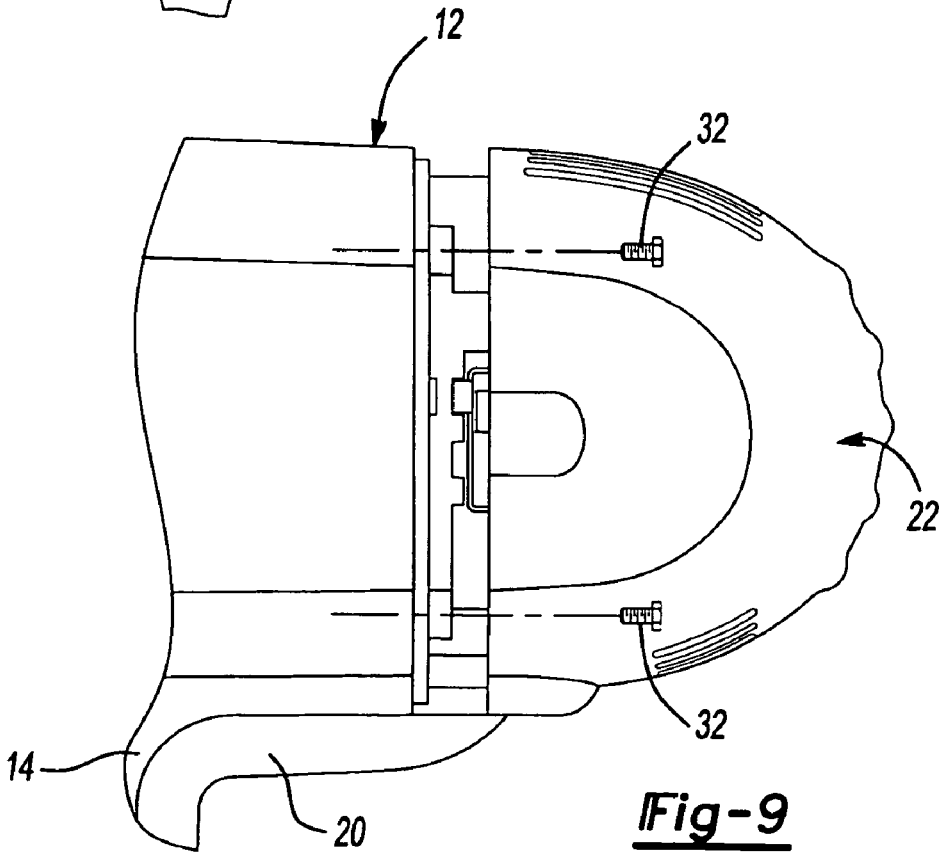
FIG. 9 illustrates engagement of the end cap to the field case and rear handle portion according to the principles of the present invention.

With reference to FIG. 9, the end cap 22 is then installed over the rear of the field case 12 and secured by fasteners 32. The end cap 22 covers the remaining exposed wires 112 which are connected to the motor 40. The end cap 22 has a step feature that engages the top rear portion of the rear handle portion 20 and secures the rear handle portion 20 to the rails on the field case 12. Installation of the end cap 22 completes the assembly of the power tool 10.

With the power tool housing design and assembly method of the present invention, the front handle design simplifies the wire-up of the power tool. The wire-up is simplified primarily because all wire-up occurs on the rear side of the handle with no need to flip the tool over to complete the wire-up. In addition, a soft grip surface can be applied to the rear handle portion 20 without having to alter the front handle portion 14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A handle for a power tool comprising:

a field case and first handle portion formed as a single piece, said field case including a plurality of screw bosses at a second end for mounting a gear case to said field case, said first handle portion having an opening in one side thereof;

a second handle portion attached to said first handle portion for covering said opening; and an end cap connected to a first end of said field case;

wherein said field case includes a first slide rail for engaging a corresponding second slide rail on said second handle portion, and said end cap is disposed against said second handle portion for maintaining said second slide rail of said second handle portion in engagement with said first slide rail of said field case.

2. The handle according to claim 1, wherein said field case defines a generally cylindrical motor chamber.

3. The handle according to claim 1, wherein an end portion of said first handle portion includes at least one screw boss for receiving a screw for securing said second handle portion to said first handle portion.

4. The handle according to claim 1, further comprising a trigger switch supported by said first handle portion.

5. The handle according to claim 1, wherein said field case includes a plurality of screw bosses at said first end for mounting said end cap to said field case.

6. The handle according to claim 1, wherein said opening in said first handle portion defines a first recess for receiving electrical wires therein and said first slide rail includes a pair of spaced parallel rails defining a second recess therebetween for receiving the electrical wires, said second handle portion covering said first and second recesses.

7. The handle according to claim 1, wherein said field case is closed relative to said first handle portion.

8. A handle for a power tool comprising:

a field case and first handle portion formed as a single piece, said field case being closed relative to said first handle portion, said field case including a plurality of screw bosses at a second end for mounting a gear case to said field case, said first handle portion having an opening in one side thereof, said opening defining a first recess for receiving electrical wires therein, said field case including a first slide rail including a pair of spaced parallel rails defining a second recess therebetween for receiving the electrical wires;

a second handle portion attached to said first handle portion for covering said opening, said second handle portion covering said first and second recesses; and an end cap connected to a first end of said field case;

wherein said field case includes a first slide rail for engaging a corresponding second slide rail on said second handle portion, and said end cap is disposed against said second handle portion for maintaining said second slide rail of said second handle portion in engagement with said first slide rail of said field case.

* * * * *